US005775800A

United States Patent [19]

Hsieh

[11] Patent Number: 5,775,800

[45] Date of Patent: Jul. 7, 1998

[54] ILLUMINATING DEVICE HAVING ROTARY SWITCH

[76] Inventor: Frank Hsieh, 9th-1 Floor, Kuang Fu South Road, Taipei, Taiwan

[21] Appl. No.: 761,608

[22] Filed: Dec. 6, 1996

[51] Int. Cl.[6] ..... F21V 23/00; F21V 3/00

[52] U.S. Cl. ..... 362/295; 362/800; 362/809

[58] Field of Search ..... 362/363, 204, 362/205, 206, 208, 295, 800, 806, 808, 809; 446/439, 485

[56] References Cited

U.S. PATENT DOCUMENTS 3,011,048 11/1961 O'Brien ..... 362/208
3,935,658 2/1976 Simpson ..... 362/61

FOREIGN PATENT DOCUMENTS 588456 5/1947 United Kingdom ..... 362/206

*Primary Examiner*—Y My Quach
*Attorney, Agent, or Firm*—Browdy and Neimark

[57] ABSTRACT

An illuminating device comprises a base dimensioned to fit into the receiving cavity of an article. The base is provided therein with a threaded portion, a battery compartment, a lighting compartment, a first circular surface located between the threaded portion and the battery compartment, and a second circular surface located between the battery compartment and the lighting compartment. A light-emitting body is located in the lighting compartment and is provided with a first pin in contact with a battery set located in the battery compartment, and a second pin extending to locate on the first circular surface. A rotary switch is engaged with the threaded portion of the base and is provided with a conduction piece and an elastic conduction body located between the conduction piece and the battery set. The rotary switch is rotated to cause the conduction piece to remain in contact with the second pin so as to bring about the illuminating effect.

7 Claims, 5 Drawing Sheets

ILLUMINATING DEVICE HAVING ROTARY SWITCH

FIELD OF THE INVENTION

The present invention relates generally to an illuminating device, and more particularly to an illuminating device which is simple in construction and has a rotary switch.

BACKGROUND OF THE INVENTION

The conventional illuminating devices, such as those which are used in the flash light and other types of the hand-held flashing devices, are generally provided with a sliding switch or a press switch in conjunction with a complicated circuit construction. Such conventional illuminating devices as described above can not be made economically and repaired easily. As a result, the incorporation of such conventional illuminating devices into a toy or an article will result in a substantial increase in the production cost of the toy or article. In addition, the sliding switch and the press switch are often provided with a pointed projection to facilitate the easy switching. The pointed projection of the switch is a safety hazard.

The U.S. patent Ser. No. 08/675,710 discloses a luminous circuit housing with rotary switch, which comprises a lighting body having a long pin and a short pin. The long pin is partially enclosed in an insulation jacket which must be located with precision. In addition, the insulation jacket is vulnerable to wear caused by the mechanical frictions of the batteries and the cell wall, thereby resulting in a poor conduction or a short circuit of the luminous circuit.

SUMMARY OF THE INVENTION

It is therefore the primary objective of the present invention to provide an illuminating device, which has a rotary switch and is simple in construction.

It is another objective of the present invention to provide an illuminating device with a rotary switch which is free from a safety hazard.

It is still another objective of the present invention to provide an illuminating device which can be assembled easily and is relatively low in the rate of the mechanical breakdown.

The illuminating device of the present invention is composed of a recessed base which is dimensioned to fit into the receiving cell of an article. The base has a threaded portion, a battery cell, a lighting cell, a first circular surface located between the threaded portion and the battery cell, and a second circular surface located between the battery cell and the lighting cell. A light-emitting body is disposed in the lighting cell and is provided with a first pin in contact with the battery set, and a second pin extending to locate on the first circular surface. A rotary switch is engaged with the threaded portion of the base and is provided with a conduction piece and an elastic conduction body located between the conduction piece and the battery set. The rotary switch is rotated to cause the conductive piece to remain in contact with the second pin so as to bring about the illuminating effect The foregoing objectives, features, functions and advantages of the present invention will be more readily understood upon a thoughtful deliberation of the following detailed description of the embodiments of the present invention in conjunction with the accompanying drawings.

DETAILED DESCRIPTION OF THE INVENTION

As illustrated in FIGS. 1–8, the illuminating device of the present invention is intended to serve as an adjunct which is mounted in a transparent or translucent receiving cell 11 of an article 10 for the purpose of giving an added amusement or decorative effect to the article 10.

Figure 1:
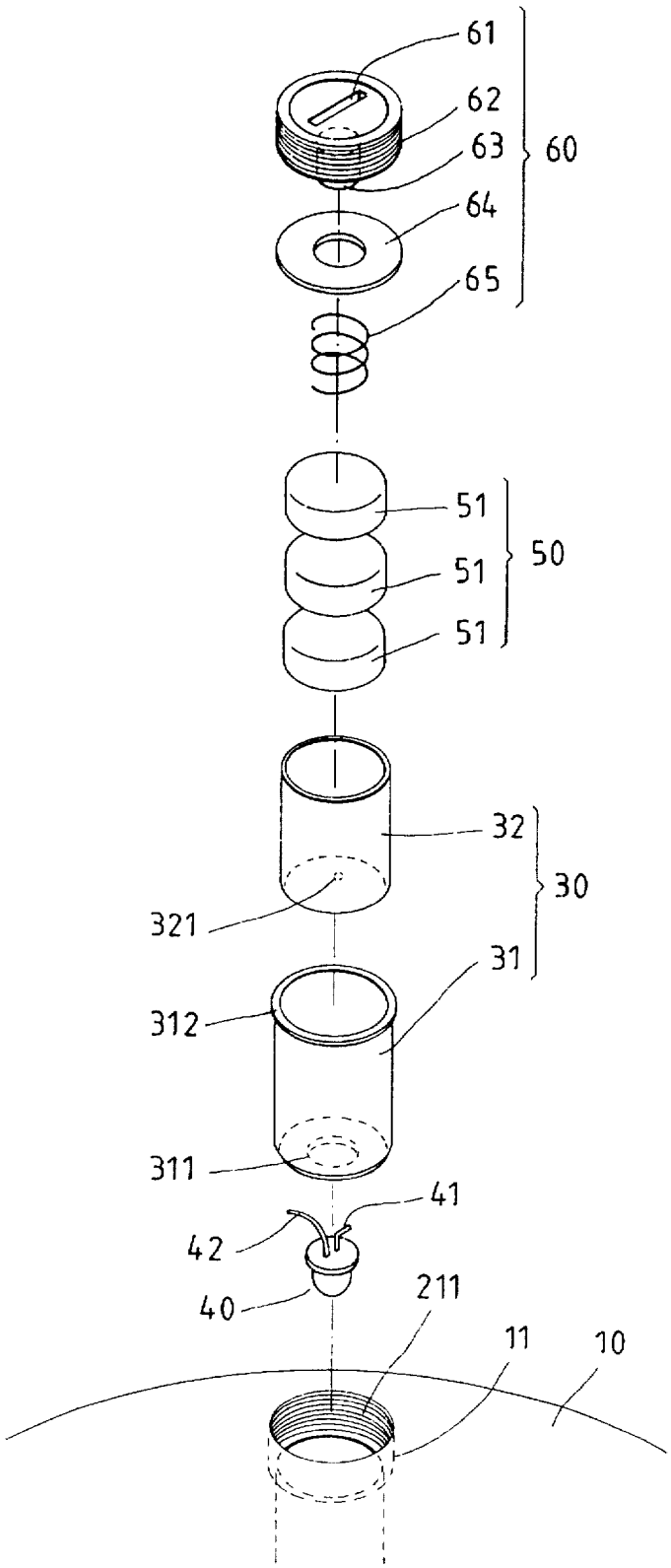
FIG. 1 shows an exploded view of a first preferred embodiment of the present invention.
Figure 2:
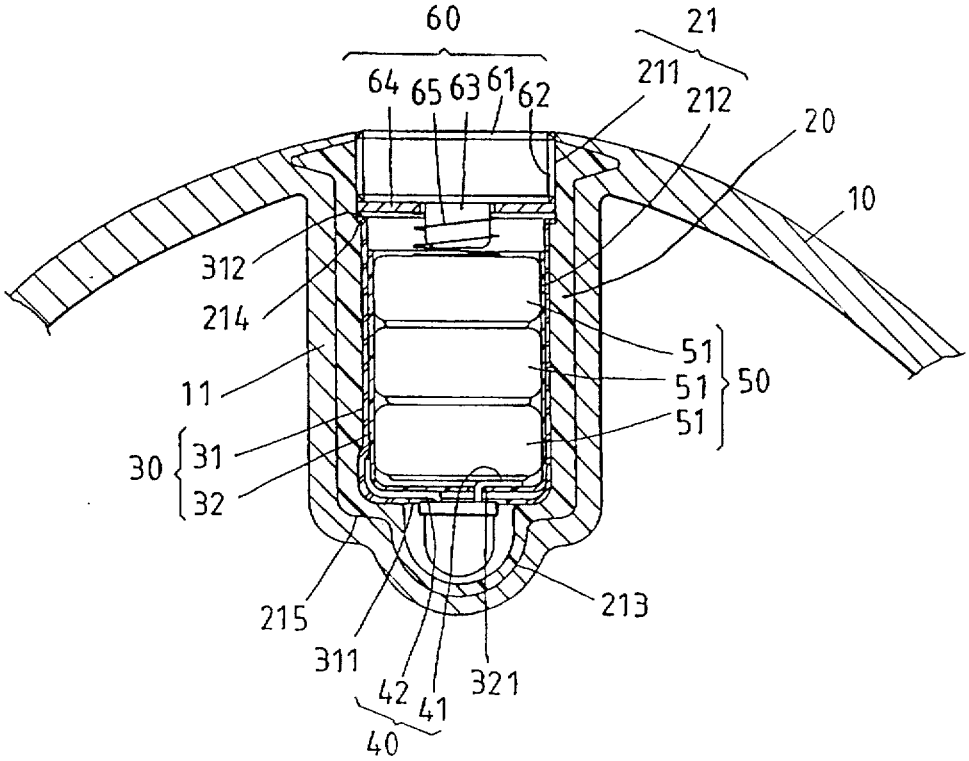
FIG. 2 is a sectional view of the first preferred embodiment in combination to illustrate the "OFF" state of the present invention.

As shown in FIGS. 1 and 2, an illuminating device of the first preferred embodiment of the present invention comprises a base 20, a conduction member 30, a light-emitting body 40, a battery set 50, and a rotary switch 60.

The base 20 is mounted in the receiving cell 11 of the article 10 by precasting and is provided with a center bore 21 having a female threaded portion 211 which is of a stepped construction and is gradually decreased in width toward one end contiguous to the interior of the article 10. The center bore 21 further has a battery compartment 212, a lighting compartment 213, a first circular surface 214 formed between the female threaded portion 211 and the battery compartment 212, and a second circular surface 215 formed between the battery compartment 212 and the lighting compartment 213. The base 20 is transparent or translucent.

The conduction member 30 has an outer conduction tube 31 and an inner insulation tube 32. The outer conduction tube 31 is made of a conductive metal material and is provided at the center of a bottom end thereof with a through hole 311. The periphery of the bottom end of the outer conduction tube 31 is in contact with the second circular surface 215. The outer conduction tube 31 is provided at a top end thereof with a lip 312 extending from the periphery of the top end such that the lip 312 is rested on the first circular surface 214. The inner insulation tube 32 is made of an insulating material and is smaller in outer diameter than the outer conduction tube 31. The inner insulation tube 32 and the battery compartment 212 are about equal in length to each other so as to enable the battery compartment 212 to be insulated from the outer conduction tube 31. The inner insulation tube 32 is provided with a guide hole 321.

The light-emitting body 40 is a light-emitting diode (LED) and is located under the through hole 311 of the outer conduction tube 31 in the lighting compartment 213. The light-emitting body 40 has a first pin 41 and a second pin 42. The light-emitting body 40 is located in the lighting compartment 213 such that the first pin 41 is received in the battery compartment 212 via the guide hole 321 of the inner insulation tube 32, and that the second pin 42 is sandwiched between the inner insulation tube 32 and the outer conduction tube 31, and further that the conductive portion of the second pin 42 is extended to remain on the second circular surface 215.

The battery set 50 comprises three batteries 51, which are stacked together such that the middle battery 51 and the bottom battery 51 are located in the upper portion of the inside of the inner insulation tube 32 and are in contact with the first pin 41 of the light-emitting body 40. The battery 51 of the battery set 50 may be increased in number, depending on the load requirement.

The rotary switch 60 is of a disklike construction and is provided with an actuating portion 61 to facilitate the turning of the rotary switch 60 with fingers. The rotary switch 60 is further provided in the outer surface of the periphery thereof with a male threaded portion 62 which is engaged with the female threaded portion 211 of the base 20. The rotary switch 60 is still further provided in the underside thereof with a seat 63 which is smaller in diameter than the rotary switch 60 and is fitted into a conduction piece 64 and an elastic conduction body 65 of an elastic metal material. The elastic conduction body 65 enables the seat 63 of the rotary switch 60 to remain between the conduction piece 64 and the battery set 50. The elastic conduction body 65 serves to connect the conduction piece 64 with the battery set 50 and to urge the battery set 50 in such a manner that the bottom battery 51 of the battery set 50 is in contact with the first pin 41 of the light-emitting body 40. In addition, the elastic conduction body 65 serves to keep the conduction piece 64 apart from the lip 312 of the outer conduction tube 31 under the normal circumstance.

When the rotary switch 60 remains in the "OFF" state, as shown in FIG. 2, the conduction piece 64 is disconnected with the lip 312 of the outer conduction tube 31. As a result, the light-emitting body 40 is incapable of emitting light.

Figure 3:
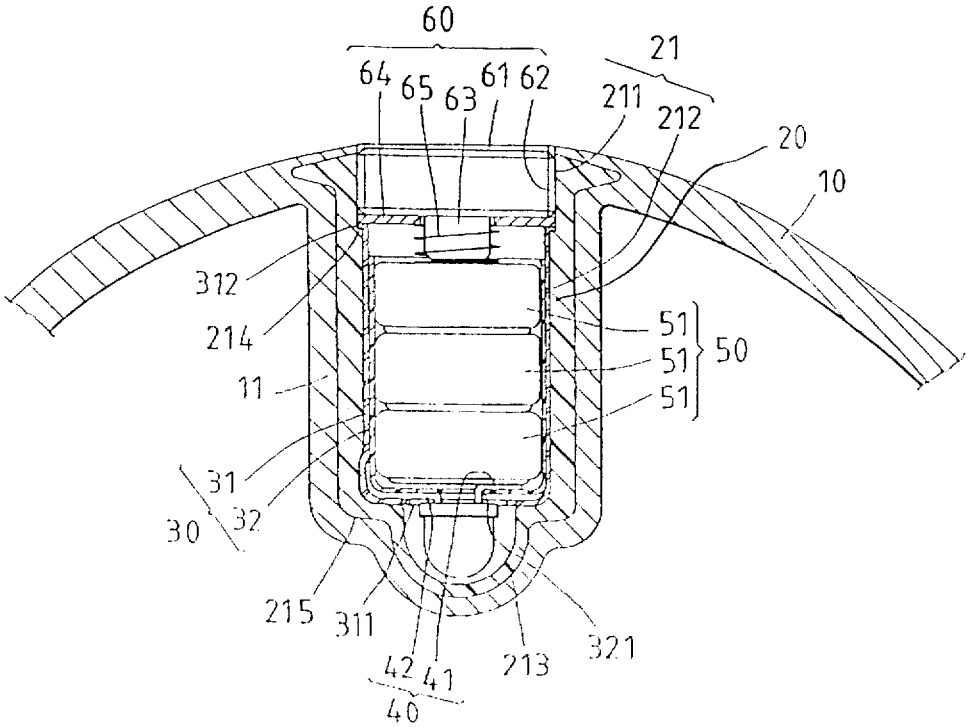
FIG. 3 is a sectional view of the first preferred embodiment in combination to illustrate the "ON" state of the present invention.

As the rotary switch 60 is rotated downwards to remain in the "ON" state, as illustrated in FIG. 3, the conduction piece 64 is in contact with the lip 312 of the outer conduction tube 31, thereby enabling voltage to be applied to the LED of the light-emitting body 40.

Figure 4:
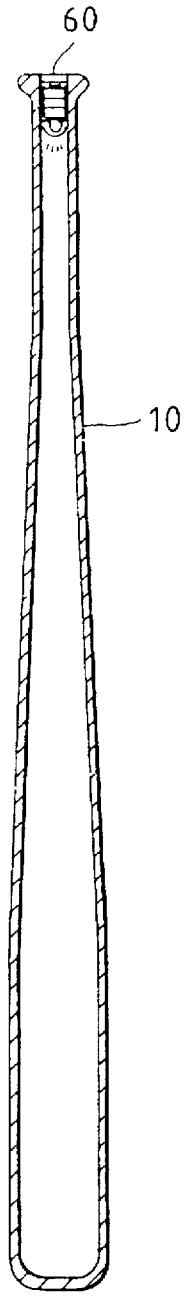
FIG. 4 is a schematic view showing that the device of the present invention is mounted in a baseball bat.
Figure 5:
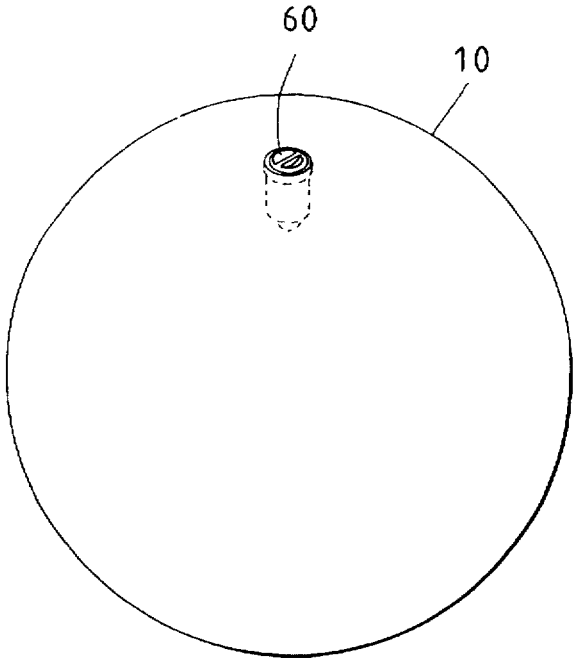
FIG. 5 is a schematic view showing that the device of the present invention is embedded in the cover of a hollow ball.
Figure 6:
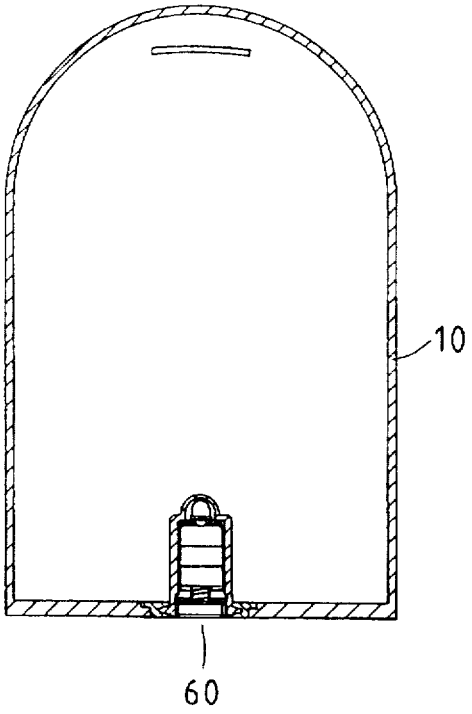
FIG. 6 is a schematic view showing that the device of the present invention is fastened with a toy.

As shown in FIGS. 4–6, the illuminating device of the present invention can be incorporated into a variety of articles, such as a baseball bat, a ball, a toy, etc., for the purpose of giving the articles an added amusement or decorative effect. It is readily apparent that the device of the present invention will be more effective if the articles are made of a transparent or translucent material. The articles may be hollow or solid.

Figure 7:
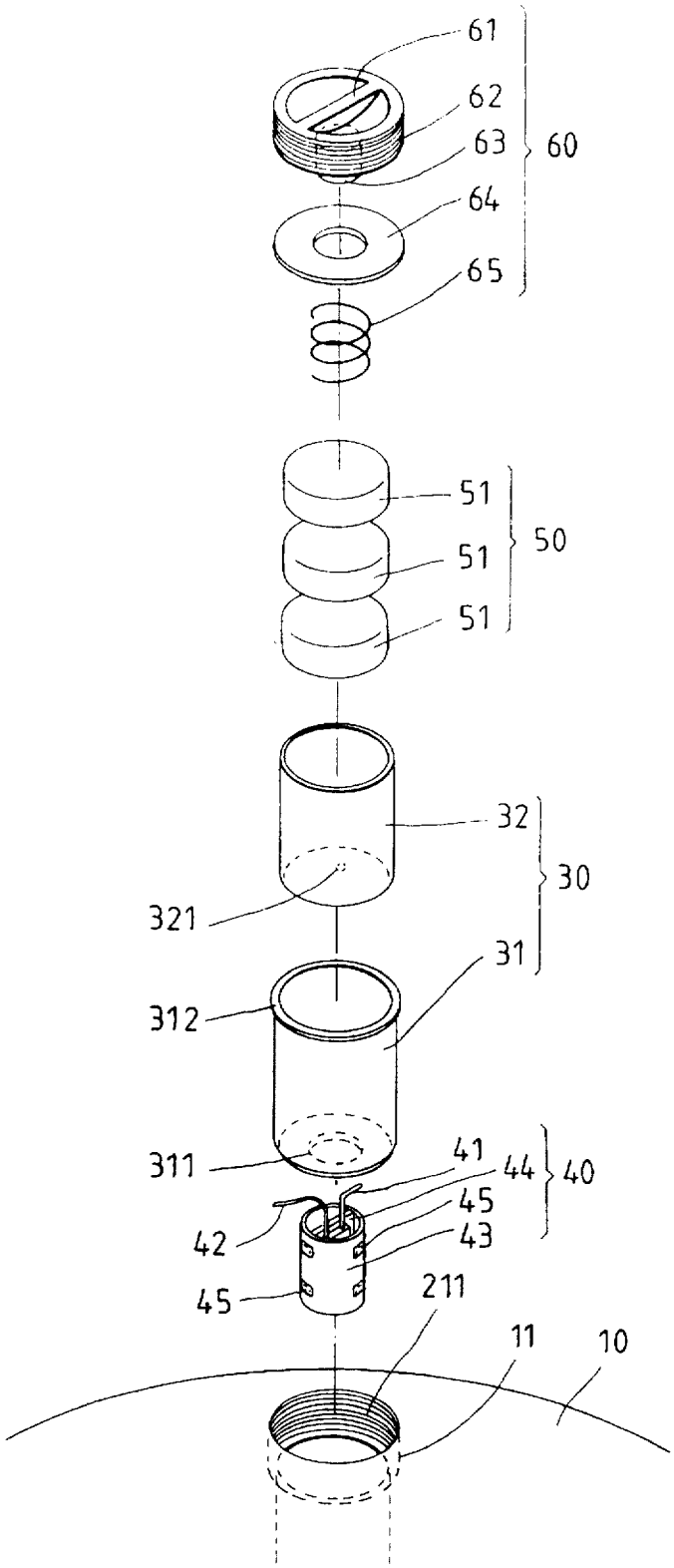
FIG. 7 shows an exploded view of a second preferred embodiment of the present invention.

As shown in FIG. 7, the device of the second preferred embodiment of the present invention is different from the device of the first preferred embodiment of the present invention in that the former comprises the light-emitting body 40 which has a cylindrical PC board 43 provided with an integrated circuit 44. The light-emitting body 40 is composed of a plurality of light-emitting diodes 45, a first pin 41, and a second pin 42. The light-emitting diodes 45 are controlled by the integrated circuit 44.

Figure 8:
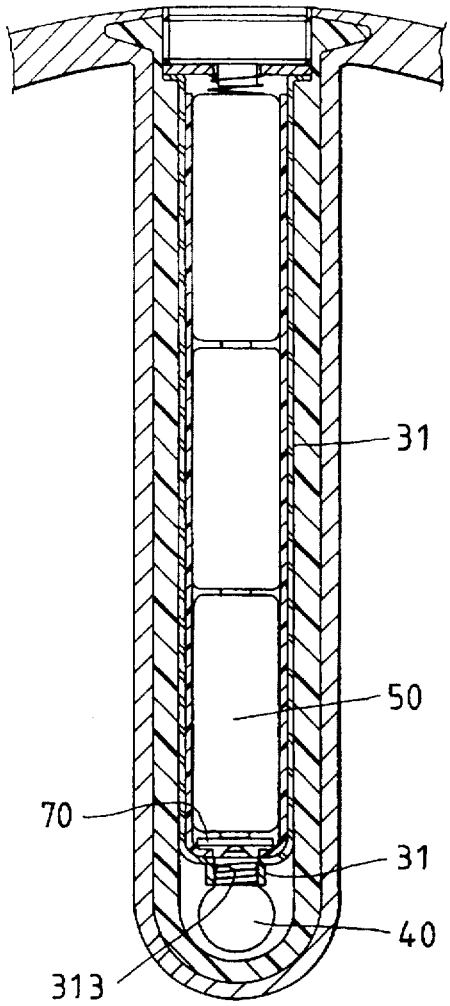
FIG. 8 shows a sectional view of a third preferred embodiment of the present invention.

The device of the third preferred embodiment of the present invention is shown in FIG. 8 and is different from the device of the first preferred embodiment of the present invention in that the former comprises an inner threaded portion 313 extending from the through hole 311 of the outer conduction tube and engageable with the threaded base of an electric bulb 40, and that the former further comprises a circuit unit 70 located between the electric bulb 40 and the battery set 50 or between the battery set 50 and the elastic conduction body 65. A circuit unit (not shown) may be formed of a plurality of the light-emitting bodies and a corresponding threaded portions 313 which are interconnected through the circuit unit. In addition, the circuit unit may be composed of an integrated circuit for controlling the effect of the glaring light-emitting body 40.

The illuminating device of the present invention has inherent advantages over the prior art devices in view of the fact that the conduction member 30 of the present invention is formed of the outer conduction tube 31 and the inner insulation tube 32 and can be therefore assembled easily. In addition, the second pin 42 of the present invention is protected by the outer conduction tube 31 and the inner insulation tube 32 such that the second pin 42 is not vulnerable to wear caused by the mechanical friction of the side wall of the battery set 50, thereby reducing the rate of breakdown, poor contact, or short circuit of the device of the present invention.

What is claimed is:

1. An illuminating device comprising:

a base dimensioned to fit securely into a receiving cell of an article and provided with a bore having a threaded portion, a battery compartment, a lighting compartment, a first circular surface formed between said threaded portion and said battery compartment, and a second circular surface formed between said battery compartment and said lighting compartment;

a conduction member located in said battery compartment of said base;

a light-emitting body located in said lighting compartment of said base and provided with a first pin and a second pin;

a battery set located in said battery compartment of said base, said first pin of said light-emitting body engaged to said battery set; and a rotary switch having a threaded portion rotatably engaged with said threaded portion of said base, said rotary switch having a seat, extending through a center hole of a conduction piece, and an elastic conduction body fitted over said seat, said elastic conduction body being located between said conduction piece and said battery set, wherein said elastic conduction body permits said conduction piece to make electrical contact with said second pin of said light-emitting body through said conduction member at such time when said rotary switch is rotated;

wherein said conduction member is composed of an outer conduction tube and an inner insulation tube, said outer conduction tube provided at a first end with a through hole and at a second end with a lip extending from a periphery of said second end to engage said first circular surface, said inner insulation tube being fitted into said outer conduction tube such that said first pin of said light-emitting body extends through said inner insulation tube and that said second pin of said light-emitting body is engaged between said through hole and said outer conduction tube to engage with said battery and said inner insulation tube.

2. The device as defined in claim 1, wherein said light-emitting body is a light-emitting diode (LED).

3. The device as defined in claim 1, wherein said first pin and said second pin of said light-emitting body extend through said through hole of said outer conduction tube of said conduction member.

4. The device as defined in claim 1, wherein said inner insulation tube of said conduction member is provided with a guide hole; and wherein said first pin of said light-emitting body extends into said battery compartment of said base through said guide hole of said inner insulation tube of said conduction member.

5. The device as defined in claim 1, wherein said light-emitting body and said battery set are provided therebetween an integrated circuit for controlling a glaring effect of said light-emitting body.

6. The device as defined in claim 1, wherein said base and said article are transparent.

7. The device as defined in claim 1, wherein said base and said article are translucent.

* * * * *